US007402335B2

(12) United States Patent
Bolms et al.

(10) Patent No.: US 7,402,335 B2
(45) **Date of Patent: *Jul. 22, 2008**

(54) LAYER STRUCTURE AND METHOD FOR PRODUCING SUCH A LAYER STRUCTURE

(75) Inventors: Hans-Thomas Bolms, Mülheim an der Ruhr (DE); Andreas Heselhaus, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 146 days.

This patent is subject to a terminal disclaimer.

(21) Appl. No.: 10/563,948

(22) PCT Filed: Jun. 17, 2004

(86) PCT No.: PCT/EP2004/006556

§ 371 (c)(1),
(2), (4) Date: Jan. 9, 2006

(87) PCT Pub. No.: WO2005/005688

PCT Pub. Date: Jan. 20, 2005

(65) Prior Publication Data

US 2006/0153685 A1 Jul. 13, 2006

(30) Foreign Application Priority Data

Jul. 9, 2003 (EP) ..... 03015495

(51) Int. Cl.
*B32B 5/14* (2006.01)

(52) U.S. Cl. ..... 428/310.5; 428/319.1; 428/305.5; 428/306.6; 428/307.3; 428/312.2; 428/312.8

(58) Field of Classification Search ..... 428/319.1, 428/305.5, 306.6, 307.3, 307.7, 312.2, 312.8, 428/310.5
See application file for complete search history.

(56) References Cited

U.S. PATENT DOCUMENTS

| | | | | |
|---|---|---|---|---|
| 3,825,364 | A | 7/1974 | Halila et al. | |
| 4,318,666 | A | 3/1982 | Pask | |
| 5,080,557 | A | 1/1992 | Berger | |
| 5,721,057 | A * | 2/1998 | Bamberg et al. | 428/469 |

(Continued)

FOREIGN PATENT DOCUMENTS

EP 0 207 029 A2 12/1986

(Continued)

OTHER PUBLICATIONS

Translation of JP 2000-301655, Harada et al, "Heat Barrier Film-Coated Member and Formation of Heat Barrier Film", Oct. 31, 2000.*

(Continued)

*Primary Examiner*—Hai Vo

(57) ABSTRACT

The invention relates to a temperature resistant layered structure comprising a substrate and a porous layer arranged on the substrate having a pore defined by a wall, and a ceramic coating on an interior surface of the wall. The invention also relates to a layered turbine component arrangement comprising a substrate having a cooling passage adapted to allow a cooling gas medium to pass through the substrate and a porous layer arranged on the substrate, the porous layer having cooling passages formed by gas-permeable inter-connections between pores in the porous layer.

9 Claims, 4 Drawing Sheets

U.S. PATENT DOCUMENTS

| | | | | |
|---|---|---|---|---|
| 6,306,424 | B1 * | 10/2001 | Vyakarnam et al. | 424/426 |
| 6,412,541 | B2 | 7/2002 | Roesler et al. | |
| 6,428,280 | B1 | 8/2002 | Austin et al. | |
| 7,070,853 | B2 * | 7/2006 | Paul | 428/304.4 |
| 2003/0021905 | A1 | 1/2003 | Lee et al. | |
| 2007/0275210 | A1 * | 11/2007 | Heselhaus | 428/116 |

FOREIGN PATENT DOCUMENTS

| | | | |
|---|---|---|---|
| EP | 0 609 795 | A1 | 8/1994 |
| EP | 0 852 223 | A1 | 7/1998 |
| JP | 10-231704 | | 9/1998 |
| WO | WO 03/006883 | A1 | 1/2003 |

OTHER PUBLICATIONS

G. Xomeritakis, Y.S. Lin; "Fabrication of a thin palladium membrane supported in a porous ceramic substrate by chemical vapor deposition"; Journal of Membrane Science; Nov. 13, 1996; pp. 261-272; vol. 120; No. 2; Elsevier Science B.V., Amsterdam, NL.

Guo-zhong Cao, Hendrik W. Brinkman, Joan Meijerink, Karel J. de Vries, and Anthonie J. Burggraaf; "Pore Narrowing and Formation of Ultrathin Yttria-Stabilized Zirconia Layers in Ceramic Membranes by Chemical Vapor Deposition / Elektrochemical Vapor Deposition"; Journal of American Ceramic Society; Sep. 1993 pp. 2201-2208; XP-001073836.

* cited by examiner

LAYER STRUCTURE AND METHOD FOR PRODUCING SUCH A LAYER STRUCTURE

CROSS REFERENCE TO RELATED APPLICATIONS

This application is the U.S. National Stage of International Application No. PCT/EP2004/006556, filed Jun. 17, 2004 and claims the benefit thereof. The International Application claims the benefits of European Patent application No. 03015495.9 EP filed Jul. 9, 2003, all of the applications are incorporated by reference herein in their entirety

FIELD OF THE INVENTION

The invention relates to a layer structure as claimed the claims and to a process for producing a layer structure as claimed in the claims.

BACKGROUND OF THE INVENTION

U.S. Pat. No. 3,825,364 shows an outer wall which is completely porous. There is a cavity between this wall and a substrate.

U.S. Pat. No. 5,080,557 shows a layer structure comprising a substrate, a porous interlayer and a completely sealed outer layer.

U.S. Pat. No. 4,318,666, compared to U.S. Pat. No. 5,080,557, additionally shows cooling passages in the substrate, to which a porous interlayer and a sealed outer layer have been applied.

JP 10-231 704 shows a substrate with cooling passages and a porous interlayer.

PCT/EP02/07029 and U.S. Pat. No. 6,412,541 show a porous structure within a wall, with the wall again having a coating on the outer side. The wall and the coating have cooling passages.

An article "Pore Narrowing and Formation of Ultrathin Yttria-Stabilized Zirconia Layers in Ceramic Membranes by Chemical Vapor Deposition/Electrochemical Vapor Deposition" by G. Cao et al. is known from the Journal of American Ceramic Society 1993, describing the deposition of a ceramic within a porous ceramic.

However, the known layer structures in some cases have inadequate cooling properties.

SUMMARY OF THE INVENTION

Therefore, the object of the invention is to improve the cooling of a layer structure.

The object is achieved by a layer structure as claimed in the claims and a process for producing a layer structure as claimed in the claims.

The subclaims list further advantageous measures relating to the configuration of the layer structure and of the process.

The measures listed in the subclaims can be combined with one another in advantageous ways.

The layer structure has cooling passages in a substrate and in a porous, gas-permeable layer on the substrate. The porous layer is formed by pores, the pores being delimited by walls. According to the invention, there is at least one coating on these walls.

If the diameters of the cooling passages and/or the pore size of the layer are locally varied, the cooling capacity can be locally varied and, for example, matched to a pressure gradient along the outer side of the layer structure.

In the invention, the thermal barrier coating as outer layer is shifted into the porous layer. This also eliminates outer walls.

If there is no longer an outer sealed wall, as in the prior art, such a wall no longer needs to be cooled, and consequently the cooling capacity drops.

A greater temperature gradient is achieved in the thermal barrier coating, which therefore protects the substrate from excessively high temperatures.

BRIEF DESCRIPTION OF THE DRAWINGS

Exemplary embodiments are explained in more detail below. In the drawing.

DETAILED DESCRIPTION OF THE INVENTION

Figure 1:
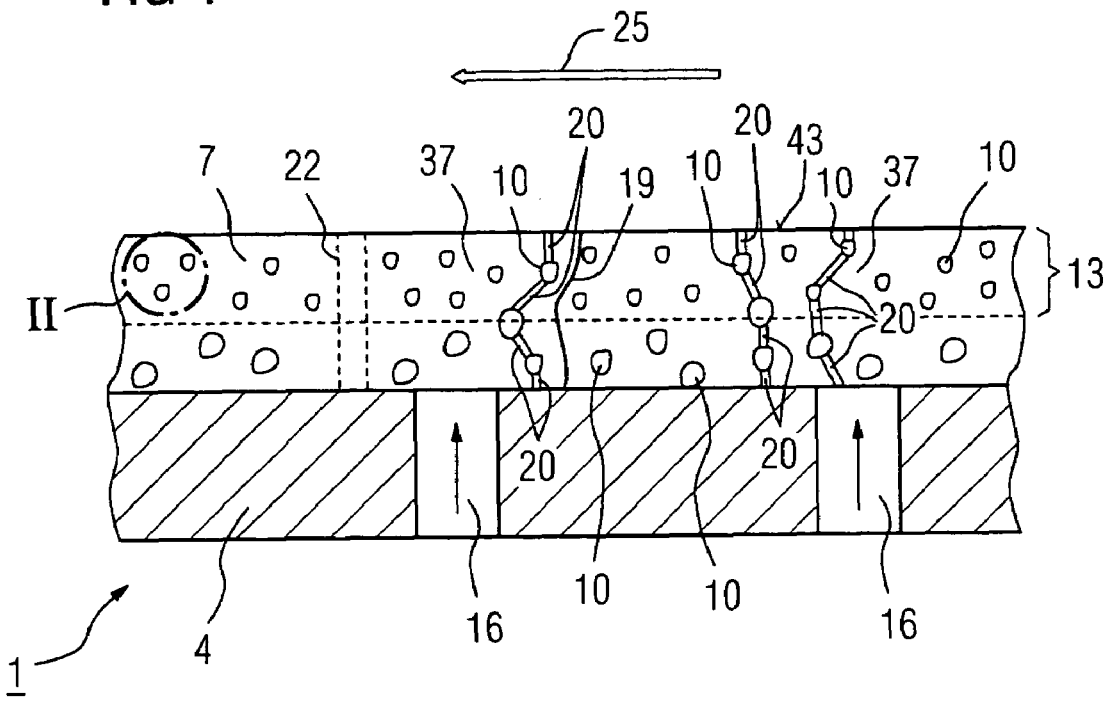
FIG. 1 shows a layer structure according to the invention in cross section.

FIG. 1 shows a layer structure 1, which at least comprises a substrate 4 and an at least partially porous, at least partially gas-permeable layer 7 which has been applied to the substrate.

The substrate 4 is, for example, a turbine component, in particular of a gas turbine 100 (FIG. 3) or a steam turbine, such as for example a supporting structure, a turbine blade or vane 120, 130, a combustion chamber lining 155 (FIGS. 4, 5) or another component which has to be cooled.

The substrate 4 is made, for example, from a nickel-base or cobalt-base superalloy.

The materials of the substrate 4 and of the layer 7 may be of the same or different type (metallic, ceramic) and/or may be similar, in particular if the interlayer 7 is produced together with the substrate 4.

Interlayers, e.g. a bonding layer, may be present between the substrate 4 and the layer 7.

The layer 7 is preferably metallic and consists, for example, of a corrosion-resistant alloy of type MCrAlX, where M is at least one element selected from the group consisting of iron (Fe), cobalt (Co) or nickel (Ni). X stands for the element yttrium (Y) and/or at least one element from the group of the rare earths.

The layer 7 may in part, i.e. restricted to certain regions, have a lower or higher porosity. Therefore, the layer 7 in any event has pores 10. The pores 10 are delimited by walls 37 (FIG. 2) and/or entries/exits of gas-permeable connections 20' (FIG. 2) in the layer 7.

Within this porous layer 7, at least one coating 40 has been applied to the walls 37 (FIG. 2) so as to line the inside of the walls.

The porous layer 7 is, for example, in foam or sponge form with an at least partially open, i.e. gas-permeable pore structure. A foam-like or sponge-like structure of this type can be produced, for example, by applying a slurry to the substrate 4. A heat treatment causes the formation of bubbles, for example as a result of the formation of gas, so as to produce a foam-like structure which is simultaneously joined to the substrate 4.

The substrate 4 has at least one cooling passage 16, through which a cooling medium, as indicated by the arrows, can flow.

The porous layer 7 is in this case of gas-permeable configuration, so that the cooling medium can flow out of the cooling passage 16 into the layer 7 and then through the pores 10 and cooling passages 19.

At the surface 43, the layer 7 has, for example, locations at which the cooling medium can emerge from the layer 7.

Figure 2:
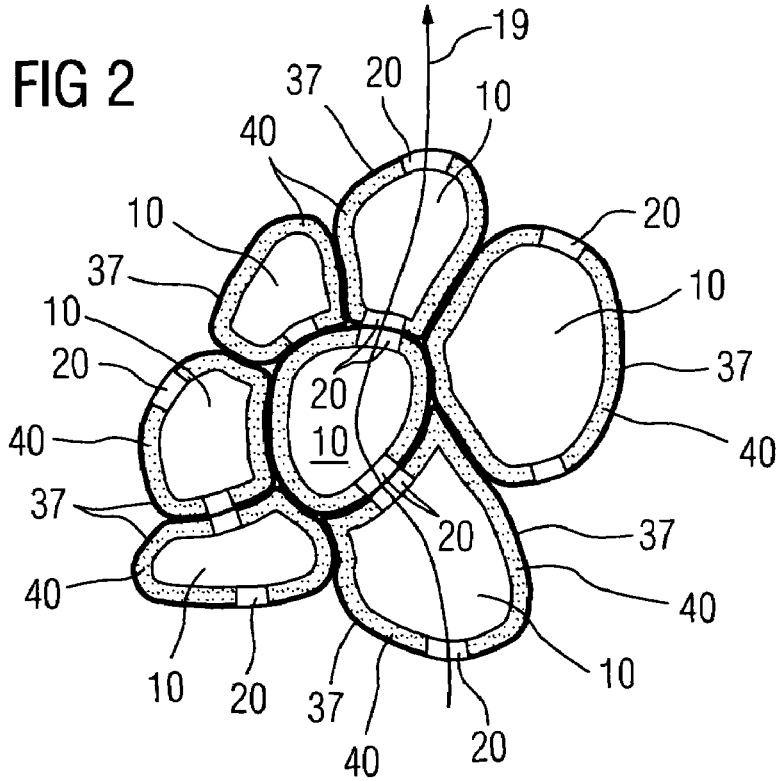
FIG. 2 shows an enlargement from FIG. 1.

In particular, here too there may be at least one cooling passage 19, in particular a cooling hole 19, i.e. without pores. The cooling passages 19 may be introduced retro-spectively. In particular, the cooling passages 19 are formed by gas-permeable connections 20 between the pores 10 (FIG. 2).

The emergence of a cooling medium from a large number of openings, i.e. the pores 10 or cooling passages 19 at the surface 43 of the layer 7 brings about effusion cooling.

The cooling passages 16, 19 are, for example, arranged in such a way with respect to one another that a cooling medium flows through the layer structure 1 as far as possible perpendicular to the surface of the substrate 4 or the layer 7.

The layer 7 does not necessarily have to have film cooling. There may also be a closed circuit for a cooling medium (gas, steam), so that no cooling medium emerges from the layer 7, but rather it flows within the layer 7, for example along a direction of flow 25 of an outer hot gas. The layer 7 is in this case not gas-permeable for example in the region of the surface 43, whereas the region below the surface remains gas-permeable (not illustrated).

In particular, there may also be partition walls 22 (indicated by dashed lines) in the layer 7, preventing the cooling medium within the interlayer 7 from flowing along the direction of flow 25, since a pressure difference is present along the direction of flow 25, as for example occurs in a gas turbine 100.

The partition wall 22 may form individual chambers in the layer 7, as known from WO 03/006883, and this option is intended to form part of the present disclosure.

The partition wall 22 may be formed by separate, for example non-porous, partition walls or by regions of the layer 7 which are not gas-permeable but are porous, or may be produced by filling up or welding the porous interlayer 7 in these regions to form sealed partition walls 22. The partition wall 22 is then, for example, a region which is not gas-permeable and therefore has a closed pore structure or no pores at all (non-porous).

The size of the pores 10 is, for example, designed to decrease toward the outer surface 43, in order to prevent soiling of the layer 7.

The configuration of the internal diameters of the cooling passages 16, 19 can be used to set the through-flow of a cooling medium in order to match it to a cooling capacity, which may be position-dependent.

This can also be set by using a position-dependent pore size in the interlayer 7.

FIG. 2 shows an enlarged view of the layer 7 from FIG. 1 which has been applied to the substrate 4.

The layer 7 is a porous or foam-like metallic layer, as has already been described in FIG. 1.

The pores 10 are delimited by walls 37 and/or by the entries/ exits of the gas-permeable connections 20 between the pores 10.

The gas-permeable connections 20 between the individual pores 10 and the pores 10 constitute the cooling passages 19.

These cooling passages do not generally run in a straight line (although they are schematically illustrated as running in a straight line in FIG. 1).

The pore structure is formed in such a way that it is possible for gas to pass from the exit opening of the cooling passage 16 in the substrate 4 to the outer surface 43 of the layer 7.

There may also be closed pores 10*g* which were closed from the outset or are closed up by the coating 40.

At least one coating 40 has been applied at least to the walls 37 in the pores 10 of the porous structure of the layer 7. At least one coating 40 may also be applied in the connections 20 and the cooling passages 16. The coating 40 of the walls 37 of the porous layer 7 may extend over the entire thickness of the layer 7 as far as the substrate 4 or may be located only in a surface region 13 of the layer 7.

Examples of layer sequences within the layer 7 or the layer structure 1.

Substrate 4: superalloy
Layer 7: MCrAlX
Coating 40: ceramic
Substrate 4: superalloy
Interlayer made from platinum
Layer 7: MCrAlX
Coating 40: ceramic
Substrate 4: superalloy
Layer 7: superalloy
First coating 40: MCrAlX
Second coating 40: ceramic (on first coating)
Substrate 4: superalloy
Layer 7: MCrAlX
First coating 40: MCrAlX, modified with respect to layer 7
Second coating 40: ceramic (on first coating)

Other combinations of the materials for substrate, interlayers, coatings and layer sequence are possible.

It is crucial for there to be a coating 40 within a porous layer 7.

The coating 40 is, for example, a ceramic layer, which can act in particular as a thermal barrier coating. This is, for example, aluminum oxide or yttrium-stabilized zirconium oxide.

It is in particular possible to use ceramic coatings 40, which do not require a bonding layer to attach them to the metallic interlayer 7.

The outer coating 40 may be applied by dip-coating methods, slurry application, plasma spraying or other processes.

The porous layer 7 may be prefabricated and is applied to the substrate 4, in particular directly, by soldering, adhesive bonding, welding or other attachment measures.

The porous layer 7 may also be produced together with the substrate 4, in particular by casting.

By way of example, the following procedure can be adopted for the production of the coating 40.

The porous layer 7 is sprayed with a ceramic slurry or dipped in a corresponding liquid (dip coating method), so that a green layer is deposited on the walls 37 of the porous structure 7, which can still be densified. This can be done by sintering or by laser methods.

The layer system 1 can be used for newly produced components or for refurbished components.

In the case of refurbished components, components, in particular turbine blades or vanes 120, 130 (FIG. 3) and combustion chamber parts (FIGS. 4, 5), can be refurbished after they have been used by removing the outer layers and further corrosion or oxidation layers. In the process, the component is also checked for cracks, which are repaired if necessary.

Then, the component can again be provided with protective layers 7, 40 in order to form a layer system 1.

Figure 3:
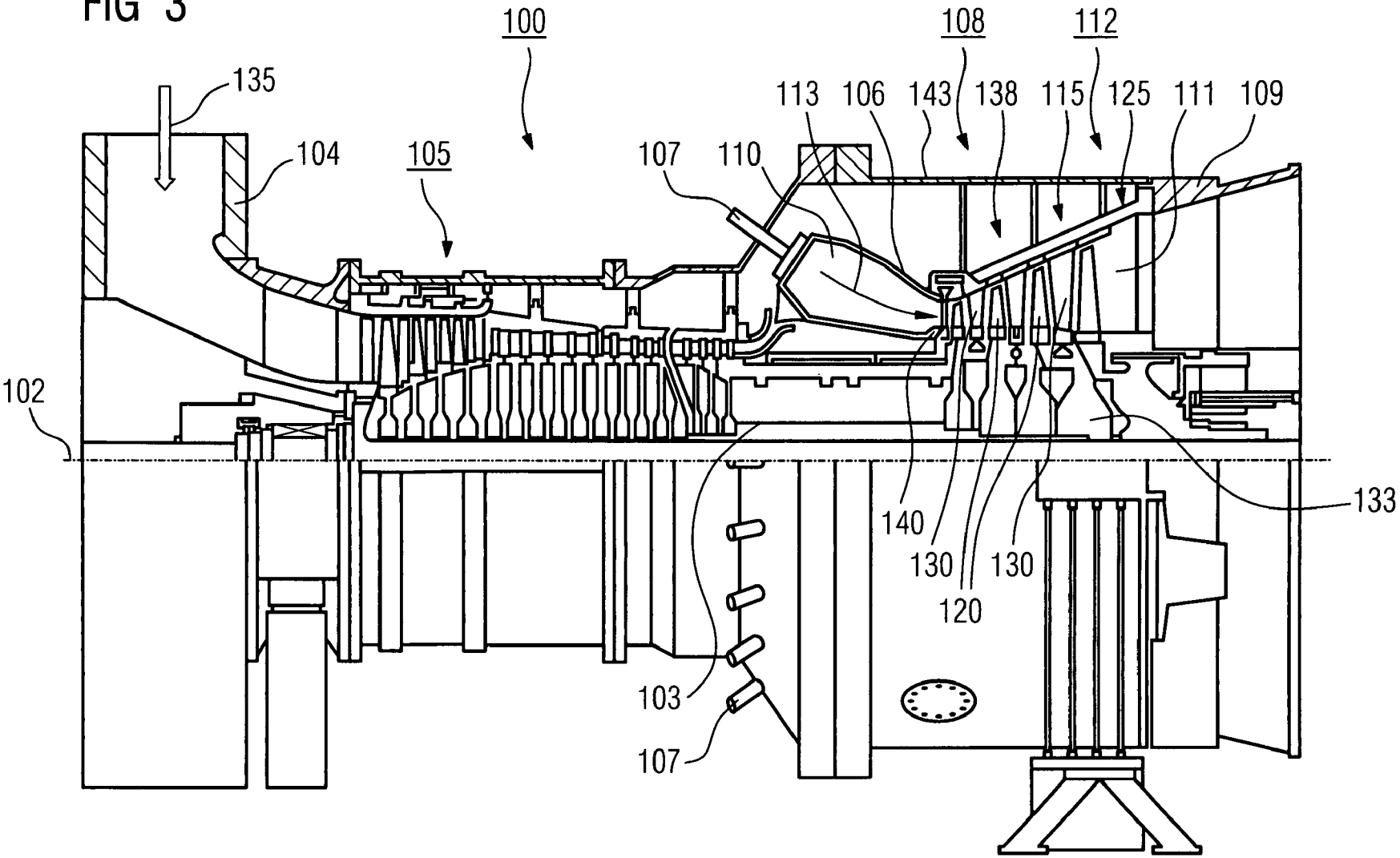
FIG. 3 shows a gas turbine.

FIG. 3 shows a partial longitudinal section through a gas turbine 100.

In its interior, the gas turbine 100 has a rotor 103, which is mounted such that it can rotate about an axis of rotation 102 and is also referred to as the turbine rotor.

An intake housing 104, a compressor 105, a for example toroidal combustion chamber 110, in particular an annular combustion chamber 106, with a plurality of coaxially arranged burners 107, a turbine 108 and the exhaust-gas housing 109 are arranged in succession along the rotor 103.

The annular combustion chamber 106 is in communication with a, for example, annular hot-gas duct 111 where, for example, four turbine stages 112 connected in series form the turbine 108.

Each turbine stage 112 is formed from two blade/vane rings.

As seen in the direction of flow of a working medium 113, a row 125 formed from rotor blades 120 follows a row 115 of guide vanes in the hot-gas duct 111.

The guide vanes 130 are in this case secured to an inner housing 138 of a stator 143, whereas the rotor blades 120 of a row 125 are attached to the rotor 103, for example by means of a turbine disk 133. A generator (not shown) is coupled to the rotor 103.

While the gas turbine 100 is operating, the compressor 105 sucks in air 135 through the intake housing 104 and compresses it. The compressed air which is provided at the turbine-side end of the compressor 105 is passed to the burners 107, where it is mixed with a fuel. The mixture is then burnt, forming the working medium 113 in the combustion chamber 110.

From there, the working medium 113 flows along the hot-gas duct 111 past the guide vanes 130 and the rotor blades 120. The working medium 113 expands at the rotor blades 120 in such a manner as to transfer its momentum, so that the rotor blades 120 drive the rotor 103 and the latter drives the generator coupled to it.

When the gas turbine 100 is operating, the components exposed to the hot working medium 113 are subject to thermal stresses. The guide vanes 130 and rotor blades 120 of the first turbine stage 112, as seen in the direction of flow of the working medium 113, together with the heat shield bricks which line the annular combustion chamber 106, are subject to the highest thermal stresses.

To be able to withstand the temperatures prevailing there, these components are cooled by means of a cooling medium and have, for example, a layer 7 as shown in FIGS. 1, 2.

The components which are subject to high thermal stresses may be formed from substrates which have a directional structure, i.e. they are in single-crystal form (SX structure) or have only longitudinally oriented grains (DS, directionally solidified structure).

The material used is in particular iron-base, nickel-base or cobalt-base superalloys.

It is likewise possible for the blades or vanes 120, 130 to have coatings protecting against corrosion (MCrAlX; M is at least one element selected from the group consisting of iron (Fe), cobalt (Co), nickel (Ni), X stands for yttrium (Y) and/or at least one rare earth element) and heat by means of a thermal barrier coating. The thermal barrier coating consists, for example, of $ZrO_2$, $Y_2O_4$—$ZrO_2$, i.e. it is not stabilized or is partially or completely stabilized by ytrrium oxide and/or calcium oxide and/or magnesium oxide. Columnar grains are produced in the thermal barrier coating by suitable coating processes, such as for example electron beam physical vapor deposition (EB-PVD).

Figure 4:
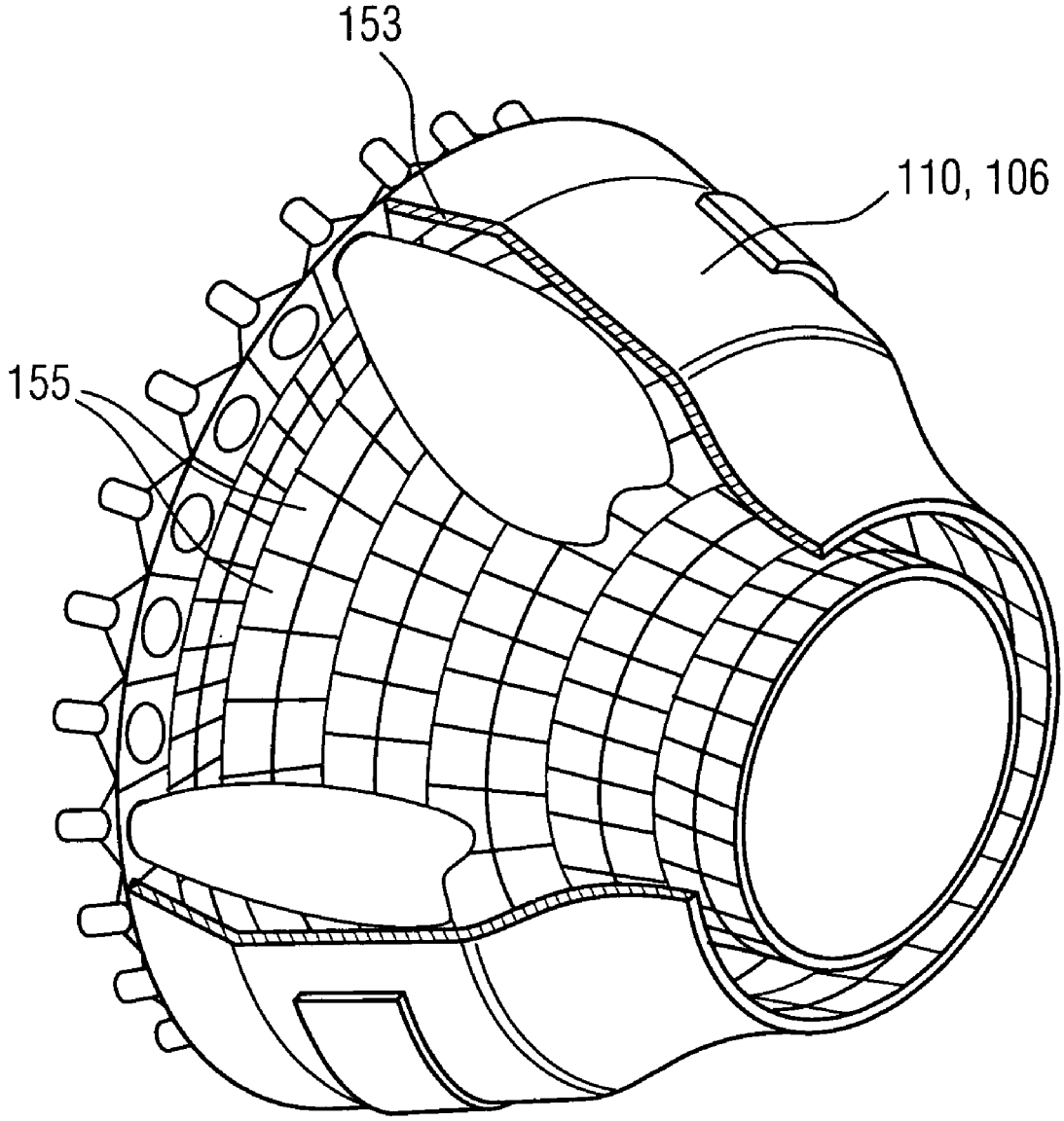
FIG. 4 shows a combustion chamber.

FIG. 4 shows a combustion chamber 110 of a gas turbine 100. The combustion chamber 110 is configured, for example, as what is known as an annular combustion chamber, in which a multiplicity of burners 102, which are arranged around the turbine shaft 103 in the circumferential direction, open out into a common combustion chamber space. For this purpose, the combustion chamber 110 as a whole is configured as an annular structure which is positioned around the turbine shaft 103.

To achieve a relatively high efficiency, the combustion chamber 110 is designed for a relatively high temperature of the working medium M of approximately 1000° C. to 1600° C. To allow a relatively long operating time even under these operating parameters, which are unfavorable for the materials, the combustion chamber wall 153 is provided, on its side which faces the working medium M, with an inner lining formed from heat shield elements 155. On the working medium side, each heat shield element 155 is equipped with a particularly heat-resistant protective layer or is made from material that is able to withstand high temperatures.

Moreover, on account of the high temperatures in the interior of the combustion chamber 110, a cooling system is provided for the heat shield elements 155 and/or for their holding elements. The heat shield elements 155 may have a layer structure 1 as shown in FIGS. 1, 2.

The materials used for the combustion chamber wall and its coatings in accordance with the present invention may be similar to those used for the turbine blades and vanes 120, 130.

Figure 5:
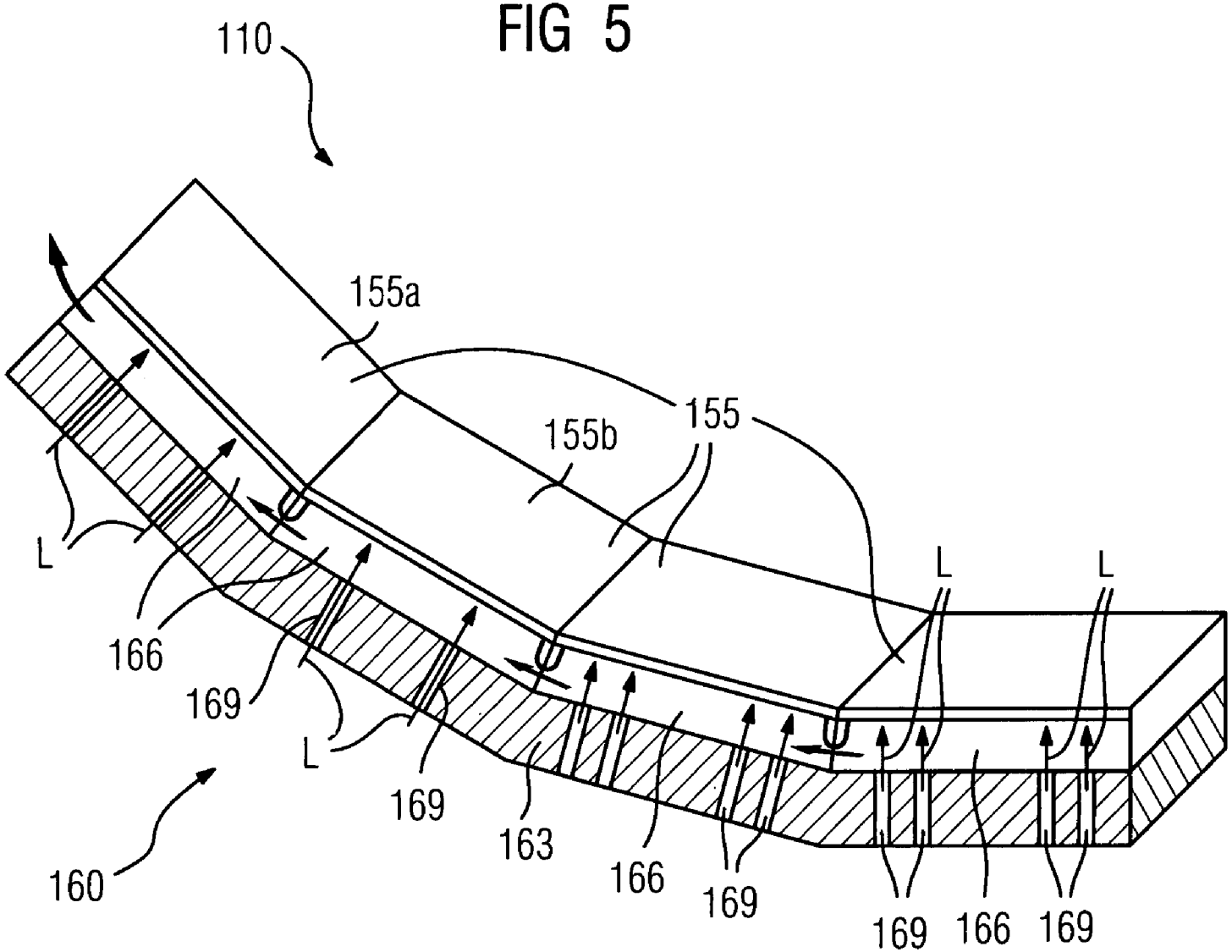
FIG. 5 shows a heat shield arrangement of a combustion chamber.

FIG. 5 illustrates a heat shield arrangement 160 in which heat shield elements 155 are arranged next to one another on a supporting structure 163, covering the surface.

It is usual for a plurality of rows of heat shield elements 155 to be arranged adjacent to one another on the supporting structure 163, for example in order to line a larger hot-gas space, such as for example a combustion chamber 110. The heat shield arrangement 160 may, for example, line the combustion chamber 110 and/or a transition region between combustion chamber 110 and turbine blade or vane 112 of a gas turbine 100, in order to prevent damage to the supporting structure 163 while the gas turbine 100 is operating.

To reduce thermal loads, there is provision, for example, for the heat shield elements 155 each to be cooled by means of cooling air on their surface which is remote from the combustion chamber 110.

At least two adjacent heat shield elements 155*a*, 155*b* form a cooling air passage 166 between the supporting structure 163 and in each case that surface of the heat shield elements 155*a*, 155*b* which faces away from the hot gas 113. In this way, the two adjacent heat shield elements 155*a*, 155*b* mentioned are in communication, for example, by way of the cooling air flow L, which passes directly from one of the adjacent elements to the other in the common cooling air passage 166 formed by the adjacent elements.

FIG. 5 illustrates, as an example, four heat shield elements 155 which form a common cooling air passage 166. However, it is also appropriate to use a considerably greater number of heat shield elements, which may also be arranged in a plurality of rows.

The cooling air L, which is fed into the cooling air passage 166 through openings 169, 16 (FIG. 1), cools the heat shield elements 155 on their rear side, for example by means of impingement cooling, with the cooling air L impinging virtually perpendicularly on that surface of the heat shield elements 155 which is remote from the hot gas, and thereby being able to absorb and dissipate thermal energy. Furthermore, the heat shield elements 155 can be cooled by convection cooling, in which case cooling air L sweeps along the rear side of the heat shield elements 155, substantially parallel to their surface, and can thereby likewise absorb and dissipate thermal energy.

In FIG. 5, the cooling air L moves as a cooling air flow largely from right to left in the cooling air passage 166 formed jointly by the heat shield elements 155, and can be fed to a burner 107, which is located for example in the combustion chamber 110, in order to be used for the combustion.

The heat shield elements 155 have, for example, a layer structure 1 according to the invention as shown in FIG. 1.

The layer structure 1 also makes it possible to dispense with the cooling passage 166 by virtue of a heat shield element 155 having the layer structure 1 being applied, for example, direct to the supporting structure 163, 4.

The invention claimed is:

1. A temperature resistant layered structure, comprising:

a substrate formed of metallic or ceramic material; and a porous layer arranged on the substrate with an outer surface spaced away from the substrate, and having a plurality of pores formed therein with each pore defined by a wall, and a ceramic coating on an interior surface of the wall, the porous layer characterized by sizes of the pores decreasing as the layer extends toward the outer surface.

2. The layered structure of claim 1, wherein the layered structure is exposed to a temperature between 1000° C. and 1600° C.

3. The layered structure as claimed in claim 1, wherein the porous layer is in a foam or a sponge form.

4. The layered structure as claimed in claim 1, further comprising an intermediate layer interposed between the substrate and the porous layer.

5. The layered structure as claimed in claim 1, wherein the substrate and the porous layer comprise different materials.

6. The layered structure as claimed in claim 1, wherein the porous layer has a plurality of pores, each pore having the ceramic coating on the interior surface of the wall.

7. The layered structure as claimed in claim 1, wherein a ceramic coating is arranged on a surface region of the porous layer that is in contact with a hot working medium.

8. The layered structure as claimed in claim 1, wherein the porous layer is soldered, welded or adhesively bonded to the substrate, and the ceramic coating is applied to the pore by dip-coating, layer build-up or plasma spraying.

9. A temperature resistant layered structure, comprising:

a substrate formed of metallic or ceramic material; and a porous layer arranged on the substrate with an outer surface spaced away from the substrate, and having a plurality of pores formed therein with each pore defined by a wall, and a ceramic coating on an interior surface of the wall, wherein the ceramic coating is $ZrO_2$, or $Y_2O_4$—$ZrO_2$, the porous layer characterized by sizes of the pores decreasing as the layer extends toward the outer surface.

* * * * *